US005125337A

United States Patent [19]

Zeller

[11] Patent Number: 5,125,337

[45] Date of Patent: Jun. 30, 1992

[54] PRINTING CYLINDER GROOVE FILLER

[75] Inventor: Reinhard Zeller, Augsburg, Fed. Rep. of Germany

[73] Assignee: Man Roland Druckmaschinen AG, Offenbach, Fed. Rep. of Germany

[21] Appl. No.: 640,691

[22] Filed: Jan. 14, 1991

[30] Foreign Application Priority Data

Feb. 22, 1990 [DE] Fed. Rep. of Germany ... 9002111[U]

[51] Int. Cl.[5] ..... B41F 7/02; B41F 21/00

[52] U.S. Cl. ..... 101/217; 101/415.1

[58] Field of Search ..... 101/415.1, 379, 216, 101/217; 51/351, 370, 371

[56] References Cited

U.S. PATENT DOCUMENTS 4,742,769 5/1988 Zeller ..... 101/415.1 X 4,815,380 3/1989 Fischer ..... 101/415.1

FOREIGN PATENT DOCUMENTS 150573 9/1981 German Democratic Rep. ..... 101/415.1

*Primary Examiner*—Edgar S. Burr

*Assistant Examiner*—Moshe I. Cohen

*Attorney, Agent, or Firm*—Frishauf, Holtz, Goodman & Woodward

[57] ABSTRACT

To distribute loading, and reduce wear, on filler inserts upon roll-off of printing machine cylinders formed with axial grooves, such as rubber blanket cylinders in offset printing machines, the filler insert is formed with an axially curved edge or surface (9, 10; 16, 18) which, either, is provided at the engagement surface of the respective filler insert element with the bottom wall (23, 24) of the groove (3, 4) or, alternatively, at the outer or top surface. The degree of curvature is such that, with respect to a flat surface tangent to the curved surface, a spacing or gap of. at the most, 0.2 mm, and preferably only about 0.1 mm, will result.

16 Claims, 2 Drawing Sheets

PRINTING CYLINDER GROOVE FILLER

Reference to related patent, the disclosure of which is hereby incorporated by reference, assigned to the assignee of the present invention: U.S. Pat. No. 4,742,769, Zeller to which German Patent 35 40 581 corresponds.

FIELD OF THE INVENTION

The present invention relates to rotary printing machines, and more particularly to rotary printing machines having cylinders which are engaged against each other under substantial pressure, and where the cylinders are formed with axially extending grooves, the grooves being filled by groove filler elements.

BACKGROUND

When printing machine cylinders formed with grooves roll off against each other, shocks result as the circumference of the cylinders changes from a smooth circumferential region to the groove, and back to another smooth circumferential region. Usually, these cylinders are blanket cylinders, such as rubber blanket cylinders in rotary offset printing machines.

The referenced U.S. Pat. No. 4,742,769, assigned to the assignee of the present invention, the disclosure of which is hereby incorporated by reference, describes a rail-like filler element which, preferably, in cross section is essentially mushroom-shaped. It can be engaged against the bottom of a blanket attachment groove, either directly or indirectly. Such fillers provide for damping of impacts which arise as cylinders roll off against the grooves. Reducing these impacts improves the quality of printing. The filler insert described in the aforementioned patent is of relatively short axial length. When two cylinders roll off against each other, while being pressed against each other with substantial force, which may be in the order of one or two tons, the filler elements are highly loaded because, due to the comparatively short axial extent, the per square unit load placed thereon is very high. As a consequence, the filler element is subject to wear and tear and, further, expensive specialty high wear resistant materials must be used.

Other filler elements have been proposed, for example as described in German Patent 36 44 501, which are of about the same length as the cylinder; these filler elements, it has been found, have insufficient effect with respect to damping of shocks arising as printing machine cylinders roll off against each other at the grooves. It appears that this is due to the extreme loading at the edge regions, that is, at the ends of the cylinders applied against the filler elements; at central portions of the cylinder, the loading is low and no supporting effect will be obtained.

THE INVENTION

It is an object to provide a filler element which, at the most, can be as long as the cylinder itself, and in which effective damping of groove shocks or impacts can be avoided, as cylinders and cylinder grooves roll off against each other, without, however, requiring frequent exchange of the filler element due to wear caused by the high per square or surface loading. Bend-through of the cylinders is compensated.

Briefly, a surface of the filler element is formed to be axially slightly bowed or curved. These filler elements can be as long as the cylinder, but may also be shorter, and even substantially shorter. The bending or bowing of the filler elements may be such that, in one embodiment of the invention, an inner edge adjacent the bottom of the groove is slightly curved in accordance with the expected bending line upon engaging the cylinders against each other. The outer edges of the filler element are flat so that, when two cylinders of a cylinder pair are engaged against each other, they will roll off flat against each other.

In accordance with another embodiment of the invention, rather than bowing the corners or edges adjacent the bottom, the corners or edges at the outside are slightly curved, for example slightly convex-shaped, so that, as the cylinders roll off against each other, a foreshortened engagement region between filler elements will result, looked at in axial direction of the cylinder.

Regardless of which edge of the filler element is curved or bowed, the concept, in accordance with the present invention, is to form a curved or bowed edge on a filler element to compensate for bend-through of the cylinder due to engagement pressure exerted on the cylinders against each other, while maintaining the engagement pressure even over the groove as the filler elements roll off against each other.

The arrangement in accordance with the first embodiment of the invention has the advantage that, as the grooves of engaged cylinders roll off against each other, the filler elements will be in engagement over their entire length, so that the substantial engagement pressures are suitably distributed, and the pressure per square surface unit is lower than in previously used filler elements which do not extend over the entire axial length of the cylinder while, also, compensating for deformation of the cylinder as such. Another substantial advantage obtained in accordance with the invention, and particularly when the second embodiment of the invention is used, is that the filler elements will essentially self-adjust. Due to wear and tear, the filler elements will wear down and due to foreshortening, with respect to height, as they are used and roll off against similar filler elements of another cylinder, will not bend through quite as much, so that the filler elements will straighten out. The engagement surfaces, upon roll-off of the groove of one cylinder against another, with the filler element inserted, will increase due to wear on the filler elements. As the engagement surface increases, the engagement force per square of engaged surface decreases, which counteracts wear on the filler element so that, in use, the overall time that the filler element can be in place is substantially extended with respect to heretofore used filler elements and, further, upon continued use, the wear, after a while, will be relatively less and less than before.

DRAWINGS

Figure 1:
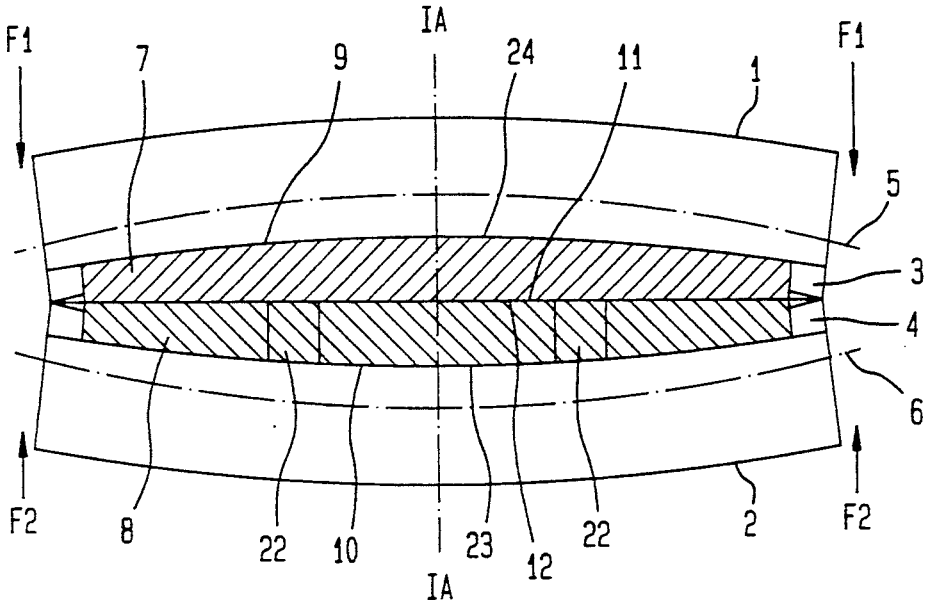
FIG. 1 is a highly schematic part-cross-sectional view through two engaged rotary printing machine cylinders with the filler elements in accordance with the present invention inserted therein, in which the filler element is matched to the expected deformation of the cylinder.
Figure 2A:
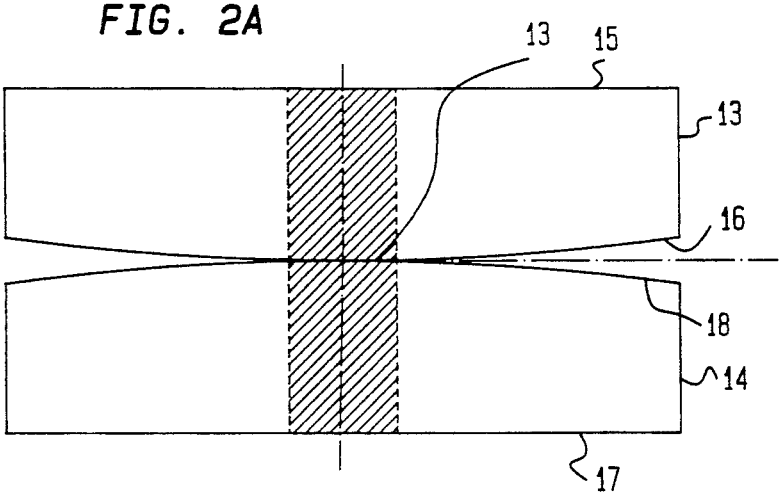
Figure 2B:
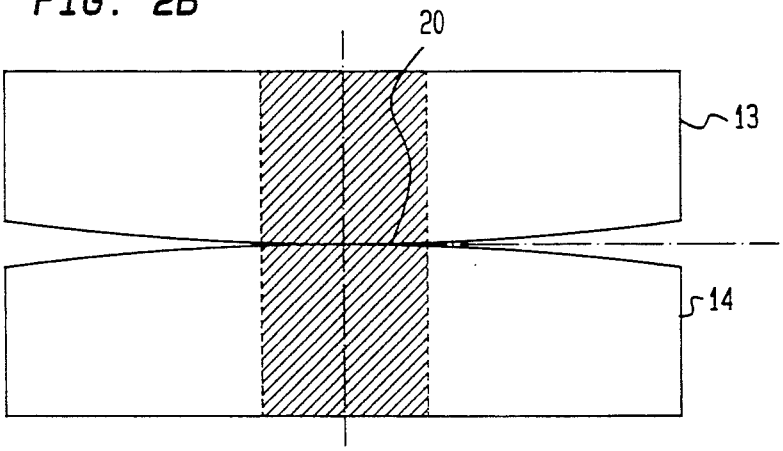

FIG. 2, collectively, is a view similar to FIG. 1, in which filler elements having a convex outer surface are inserted in cylinder grooves, and in which FIG. 2*a* shows the filler element inserted when it is new;

FIG. 2*b* shows the filler element after some use; and

Figure 2C:
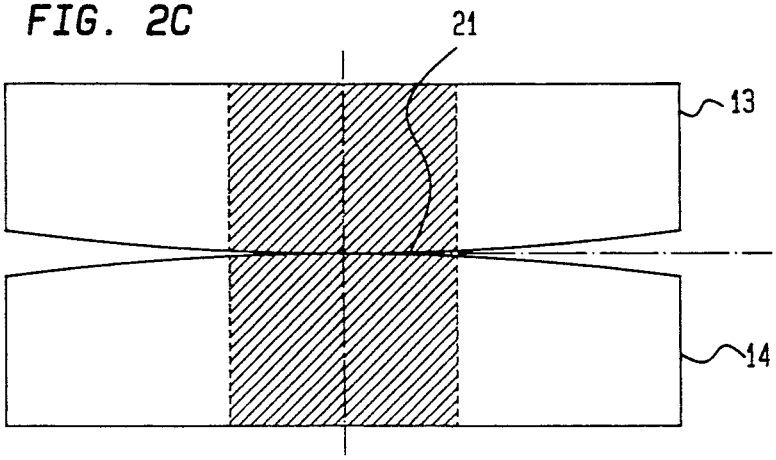

FIG. 2*c* shows the filler element after further use; and

Figure 3A:
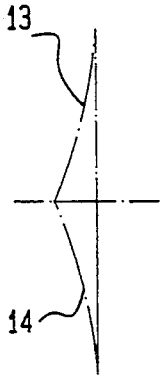
Figure 3B:
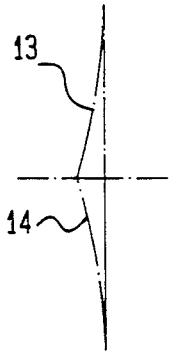

FIG. 3, collectively, is a schematic diagram, in side view, of the filler elements illustrated in FIG. 2, in which FIG. 3*a* shows the filler element when new;

FIG. 3*b* shows the filler element after some use; and

Figure 3C:
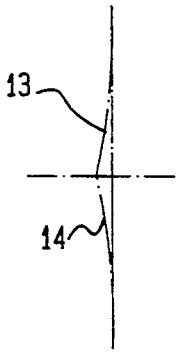

FIG. 3*c* shows the filler element after much longer use.

FIGS. 2 and 3, collectively, are drawn in alignment with each other and show, respectively, side views and top view of the filler elements.

In all the drawings, curvatures are highly exaggerated for ease of illustration; in actual practice, the curvatures are hardly noticeable.

DETAILED DESCRIPTION

Referring first to FIG. 1:

Two printing machine cylinders 1, 2, retained in side walls of a rotary printing machine (not shown), and which may, for example, be rubber blanket cylinders of a rotary offset printing machine, are formed, each, with narrow cylinder grooves 3, 4. In operation, the pairs of cylinders 1, 2 are pressed against each other with substantial force, for example in the order of 1 to 2 tons. These cylinders, customarily, are formed at their ends with bearer rings—not shown, since so well known. Due to rubber blanket adjustment, and the application of force against the bearer rings, the cylinders will have the tendency to bend through, as shown by the bending lines 5, 6, respectively, for the pairs of cylinders 1, 2 of the printing machine system.

As noted above, the illustration and the curvature are highly exaggerated for ease of illustration.

Filler elements 7, 8 are inserted in the grooves to prevent, or at least dampen as much as possible shocks which occur as the cylinder grooves 3, 4 roll off against each other. The filler elements 7, 8 are identical.

In accordance with a feature of the invention, the filler element 7, which can be described as typical, has an inner end surface 9 which is curved or bowed, corresponding to the bend or curvature line 5 for the cylinder 1, that is, bent or curved similar to the curvature to be expected by the groove bottom 24. The outer surface 11 of the filler element 7, in axial cross section, is flat or straight, looked at in axial direction. Of course, the actual surface, in circumferential direction, will be curved in accordance with the radius of curvature of the cylinder 1.

Similarly, the filler element 8 in the groove 4, with the groove bottom 23, is curved to fit the bend or curve line 6 which is expected in the cylinder 2. The outer edge 12, looked at in axial direction, again is straight. Consequently, the ends or edge lines 11, 12 are essentially parallel, and preferably truly parallel to each other.

When the cylinders 1, 2 are engaged against each other with substantial engagement force, illustrated schematically by force arrows F1, F2, for example by applying engagement pressure against bearer rings located axially outwardly and adjacent the cylinders, the cylinders may deform, as illustrated in FIG. 1 enlarged, and highly exaggerated. The filler elements 7, 8 with their outer edges 11, 12 will be engaged against each other over the entire axial length of the printing cylinder 1, 2.

The result will be that the surface loading of the filler elements 7, 8 will be substantially less than that with respect to filler elements which are substantially axially shorter than the entire axial length of the cylinders. Yet, the problems which arose in connection with known filler elements adjacent the axial ends of the fillers do not arise. In contrast to known elongated filler elements extending over essentially the entire axial length of the cylinders, the filler elements 7, 8 in accordance with the invention are substantially more effective with respect to damping or suppression of roll-over jolts and impacts as the grooves of the cylinders 1, 2 of the pair roll off against each other. Thus, the lifetime of the filler elements is improved with respect to the lifetime of axially shorter elements or, respectively, less high quality, and hence less expensive materials can be used for the filler elements which, typically, are made of steel.

It is not necessary that the filler elements extend continuously throughout the axial length of the cylinder. Rather, the filler elements can be placed in form of two or more segment-like portions 22, which are so shaped that they take over essentially the same function as a continuous filler element 8. The continuous filler element, however, is preferred, primarily since continuous elements can be manufactured much easier than a plurality of separate segments, shown schematically at 22.

Figure 1A:
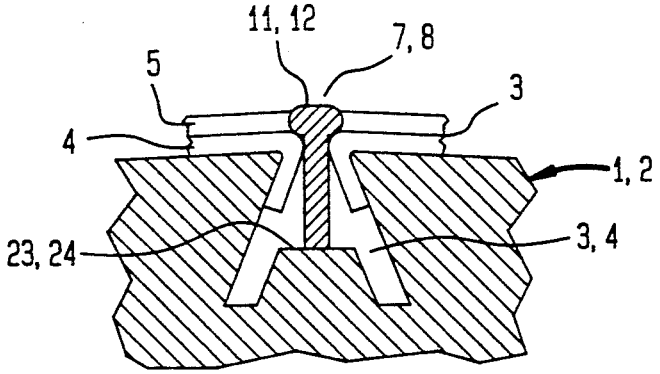
FIG. 1A is a sectional view along lines IA—IA of FIG. 1.

In cross section, the respective filler elements are preferably essentially mushroom-shaped, as shown in FIG. 1A with respect to the embodiment of FIG. 1. FIG. 1A also shows a rubber blanket 3*a* retained in the respective cylinder groove 3, 4, in any suitable and well known manner. The rubber blanket 3*a* has a lower carrier surface 4*a*, for example of fabric, and a cover layer 5*a* thereover which, typically, is rubber. Holding and clamping arrangements for the rubber blanket have been omitted from the drawing since they can be in accordance with any well known and standard construction and do not form part of the present invention. The blanket 3 is tightened by customary stretching arrangements over the edges of the respective groove 3, 4.

Rather than matching the bottom engagement surface 23, 24 of the filler element to the deformed bottom surface of the groove, it is also possible to match the top surface of filler elements 13, 14 which are fitted into cylinder grooves of printing cylinders (not shown) and which have an axially directed flat inner edge 15, 17, respectively, whereas the outer edges, remote from the inner one, namely the surfaces or edges 16, 18, are slightly bowed or curved in accordance with the bend line to be expected by the printing machine cylinder, when the cylinders are engaged against each other. Thus, they are not bent like the inner bend lines or surfaces of the filler elements 7, 8 in accordance with FIG. 1, but rather reversely, that is, the facing edges or end surfaces 16, 18 are slightly convex. When first engaged, the filler elements 13, 14, see illustration a of FIG. 2, will engage only at the center region 19. In order to prevent a line-like or point-like engagement, the engagement region is extended, which extension can be determined readily by a few experiments; preferably, the engagement surface for initial engagement can be about one-third of the axial length, located centrally, with respect to the axis of the cylinder. This surface can also be axially plan or flat, rather than curved, curving only towards the remaining axial region of the cylinder. The same advantages will obtain with the filler elements 13, 14 as those of the known short filler elements; yet, since the filler elements are much longer, a quasi automatic re-adjustment will occur, since the filler elements, in operation, will eventually wear. Illustration a of FIG. 3 shows—highly exaggerated—a filler element which is new, and not yet worn. These filler elements are relatively intensively deformed, or curved. As the filler elements are used, and due to engagement of filler elements against each other, they will be deformed, or material will be removed or abraded, resulting, effectively, in a foreshortenting of the radial length of the filler elements, compensated, however; as best seen in illustration b of FIG. 3, when the filler elements upon roll-off against an adjacent filler element in cylinder groove will then engage over a substantially longer or larger engagement surface. Illustration b of FIG. 3, as well as of FIG. 2, clearly shows the relationship. Upon continued use of the printing machine, more wear will result on the filler elements; as shown by illustration c of FIG. 3, the filler elements will hardly bend through anymore; rather, upon roll-off against an adjacent filler element in a groove, they will stand up straight; the engagement surface 21, see FIG. 2, illustration c, clearly shows the enlarged engagement area, much larger than the engagement surface 20 of illustration b.

The respectively bent surfaces or edges 16, 18 of the filler elements 13, 14 (FIG. 2) have, at their ends, a spacing gap of about 0.1 to 0.2 mm, preferably not over 0.2 mm. The illustration shown in FIG. 2, with respect to the bend or curvature of the edges 16, 18, is highly exaggerated for better visibility.

In some installations it may not be desired that the filler elements 7, 8 or 13, 14, respectively, do not bend with the respective cylinders in accordance with the bend line, for example bend lines 5, 6 (FIG. 1) which results in use of the printing machine. For such installations, a holder to attach the fillers in the cylinder grooves which includes springs is desirable. The springs permit some play, for example if freedom of movement in the region of a few tenths of a millimeter (a few 0.10 mm). A holder arrangement could be provided in the embodiment of FIG. 1, for example, essentially in the axial center of the cylinder. This permits the filler elements 7, 8 to slightly lift off the bottom engagement surface 23*a* (FIG. 1A) at the axial ends of the cylinder. When using the filler elements 13, 14 (FIG. 2), two holder arrangements for the fillers in the cylinders are preferred, so that, when the cylinders are not engaged against each other with the force F1, F2, they can slightly lift off the bottom of the cylinder groove in a central region.

If the filler elements are attached to the cylinder throughout the entire cylindrical length thereof, the filler elements, corresponding to the bend-through of the cylinder, will likewise bend with it. This is no problem, especially with cylinders which are quite long, that is, very wide printing machines.

Generally, the bending or bowing of the filler elements, whether at the bottom of the groove (FIG. 1), or at the outer surface (FIG. 2), is preferably in the order of ±0.1 mm of the bearer ring diameter or, respectively, of the theoretical pitch circle of the drive gear driving the respective cylinder. Thus, the deviation of the respectively curved surface 23, 24 from a tangential flat surface will be in the order of about 0.1 to 0.2 mm, preferably about 0.1 mm. In the embodiment of FIG. 2, and when the cylinders are not forcefully engaged against each other, the end portions of the filler element 13, 14 will lift off the bottom wall 23, 24 of the groove by, preferably, about 0.1 mm. In the embodiment of FIG. 1, the central portion of the filler element, with the cylinders disengaged, may project by, for example, and preferably, about 0.1 mm beyond the outer contour of the respective bearer ring or the theoretical pitch circle of a drive gear.

Various changes and modifications may be made, and any features described may used with any others, within the concept of the present invention.

I claim:

1. In combination with a printing machine having a pair of printing machine cylinders (1, 2) which, in operation of the machine, roll against each other, said cylinders each being formed with an axial groove (3, 4), means to compensate for bend-through of the cylinders due to engagement pressure (F) exerted on the cylinders against each other while maintaining the engagement pressure essentially even, said means including a pair of filler inserts (7, 8; 13, 14), each filler insert (7, 8; 13, 14) of the pair being of a length substantially equal to or somewhat shorter than the length of the cylinders, each filler insert being placed in the groove of a respective cylinder (1, 2), both filler inserts (7; 13) of the pair being formed with surfaces (9, 16) which are axially curved so that opposite surfaces of the filler inserts which extend in the direction of the axes of the cylinders are not parallel, and means driving said cylinder such that one filler insert in one cylinder rolls off on, and engages the other filler insert of the pair in the other cylinder (8, 14) of the cylinder pair, to maintain the engagement pressure essentially even over the groove as the filler inserts (7, 8; 13, 14) roll off against each other.

2. The combination of claim 1, wherein the filler elements (7, 8) have an edge adjacent the bottom wall (23, 24) of the grooves (3, 4) in the respective cylinder which is curved in accordance with a bend line (5, 6) expected upon engagement, under force, of said cylinders of the pair against each other;

and wherein said curved surfaces (11, 12) of the filler elements (7, 8), looked at in axial direction, have, in axial cross section, a flat, straight outline.

3. The combination of claim 1, wherein the axially curved surfaces (16, 18) are formed at the outer surfaces of the filler elements and are in engagement with each other, upon roll-off of the cylinders of the pair, only in a restricted region (19, 20, 21) with respect to the axial length of the filler insert element.

4. The combination of claim 1, wherein the extent of curvature of said curved surfaces (9, 10; 16, 18), looked at in circumferential direction of the cylinder (1, 2), has a curvature which corresponds to the radius of curvature of a bearer ring and extends ±0.1 mm with respect to said radius.

5. The combination of claim 2, wherein the extent of curvature of said curved surfaces (9, 10; 16, 18), looked at in circumferential direction of the cylinder (1, 2), has a curvature which corresponds to the radius of curvature of a bearer ring and extends ±0.1 mm with respect to said radius.

6. The combination of claim 3, wherein the extent of curvature of said curved surfaces (9, 10; 16, 18), looked at in circumferential direction of the cylinder (1, 2), has a curvature which corresponds to the radius of curvature of a bearer ring and extends ±0.1 mm with respect to said radius.

7. The combination of claim 1, wherein the curved surfaces (9, 10; 16, 18) with respect to a flat surface tangent to the curved surface, have a deviation from said flat tangent surface by, at the most, a spacing of 0.2 mm.

8. The combination of claim 3, wherein the maximum degree of curvature of the curved surfaces (16, 18) is so dimensioned that the outer ends of the insert elements (13, 14) have a spacing from a flat surface tangent to said curved surfaces of, at the most, 0.2 mm.

9. The combination of claim 1, wherein said filler insert elements (7, 8; 13, 14), in cross section, are essentially mushroom-shaped.

10. The combination of claim 2, wherein said filler insert elements (7, 8; 13, 14), in cross section, are essentially mushroom-shaped.

11. The combination of claim 3, wherein said filler insert elements (7, 8; 13, 14), in cross section, are essentially mushroom-shaped.

12. The combination of claim 1, wherein the extent of curvature of said curved surfaces (9, 10; 16, 18), looked at in circumferential direction of the cylinder (1, 2), has a curvature which corresponds to the radius of curvature of the theoretical pitch circle of a drive gear for the cylinders and extends ±0.1 mm with respect to said radius.

13. The combination of claim 2, wherein the extent of curvature of said curved surfaces (9, 10; 16, 18), looked at in circumferential direction of the cylinder (1, 2), has a curvature which corresponds to the radius of curvature of the theoretical pitch circle of a drive gear for the cylinders and extends ±0.1 mm with respect to said radius.

14. The combination of claim 3, wherein the extent of curvature of said curved surfaces (9, 10; 16, 18), looked at in circumferential direction of the cylinder (1, 2), has a curvature which corresponds to the radius of curvature of the theoretical pitch circle of a drive gear for the cylinders and extends ±0.1 mm with respect to said radius.

15. The combination of claim 1, wherein the curved surfaces (9, 10; 16, 18) with respect to a flat surface tangent to the curved surface, have a deviation from said flat tangent surface of about 0.1 mm.

16. The combination of claim 3, wherein the maximum degree of curvature of the curved surfaces (16, 18) is so dimensioned that the outer ends of the insert elements (13, 14) have a spacing from a flat surface tangent to said curved surfaces of about 0.1 mm.

* * * * *